US006550733B1

(12) United States Patent
Lassen et al.

(10) Patent No.: US 6,550,733 B1
(45) Date of Patent: Apr. 22, 2003

(54) SUPPORTING MEANS FOR A SCREENING DEVICE

(75) Inventors: Gert Godvig Lassen, Skjern (DK); Carsten Brønnum Grinvalds, Albertslund (DK)

(73) Assignee: VKR Holding A/S, Søborg (DE)

( * ) Notice: Subject to any disclaimer, the term of this patent is extended or adjusted under 35 U.S.C. 154(b) by 0 days.

(21) Appl. No.: 09/856,567

(22) PCT Filed: Feb. 11, 2000

(86) PCT No.: PCT/DK00/00057

§ 371 (c)(1),
(2), (4) Date: May 23, 2001

(87) PCT Pub. No.: WO00/47858

PCT Pub. Date: Aug. 17, 2000

(30) Foreign Application Priority Data

Feb. 12, 1999 (DK) ..... PCT/DK99/00110

(51) Int. Cl.[7] ..... E06B 9/174; A47H 1/10

(52) U.S. Cl. ..... 248/266; 248/268; 160/323.1

(58) Field of Search ..... 248/266, 254, 248/252, 261, 262, 267, 268, 273; 160/323.1, 313

(56) References Cited

U.S. PATENT DOCUMENTS 3,614,045 A 10/1971 Cegielski
4,538,785 A * 9/1985 Damsgaard ..... 248/268
5,083,601 A * 1/1992 Tedeschi ..... 160/323.1
6,283,427 B1 * 9/2001 Moller et al. ..... 248/266

FOREIGN PATENT DOCUMENTS

| | | | |
|---|---|---|---|
| DE | 3926101 A1 * | 2/1991 |
| DE | 4117039 C1 | 5/1992 |
| EP | 0465433 A1 | 1/1992 |
| EP | 0 668 430 A1 * | 8/1995 |
| EP | 0728905 A1 | 8/1996 |
| SE | 415904 B | 11/1980 |
| WO | WO 9607007 | 3/1996 |

* cited by examiner

*Primary Examiner*—Anita King
(74) *Attorney, Agent, or Firm*—Venable LLP; John P. Shannon; Chad C. Anderson

(57) ABSTRACT

A support for a window screening device includes a first pair of bracket members (6) for mounting on each of a pair of opposed parallel frame surfaces (2) engageable by the screening device. Each bracket member includes a relatively flat front part protruding from the frame surface and having a substantially smooth external surface, and the engaging mechanism (11–12; 111–112; 33–34) is provided by each coupling member (7; 107; 207; 307; 36) and includes a first engaging mechanism in the form of at least one contact surface on the coupling member engaging a circumferential surface part of a bracket member to provide temporary engagement therewith and non-resilient second engaging mechanism providing stable engagement of the coupling member with respect to the frame structure.

19 Claims, 3 Drawing Sheets

SUPPORTING MEANS FOR A SCREENING DEVICE

BACKGROUND OF THE INVENTION

The present invention relates to means for supporting a screening device in a frame structure with frame members comprising top and bottom members as well as side members and lining an opening in a building, in particular a door or a window, said means comprising a first pair of bracket members for mounting on each of a pair of opposed parallel frame surfaces of said frame structure and a second pair of coupling members each provided with means engageable by engaging means on said screening device, each of said bracket members and each of said coupling members further comprising engaging means for engagement of a coupling member with a bracket member.

Screening devices for windows and doors such as roller blinds, venetian blinds, pleated blinds and internal and external shutters are conventionally supplied together with supporting brackets which are specifically adapted to the particular form of screening device and are engageable by engaging means provided on the screening device, typically at either end thereof. During installation of the screening device the supporting brackets must be mounted by the user himself which frequently results in errors, in particular if different left-hand and right-hand brackets are mixed up.

Although it is also known to incorporate supporting brackets for a specific type of screening devices in the frame structures of doors and windows during the production thereof, so that the door or window frame structure is supplied with premounted supporting brackets, such brackets have normally been designed for use with a specific kind of screening devices such as roller blinds. If installation of another kind of screening devices such as a venetian blind is desired it has been necessary in such case to replace the premounted supporting brackets by brackets specifically designed for the desired screening device.

In addition, unavoidable production tolerances for the door or window frame structure may result in difficulties with respect to correct mounting of a screening device, whereby safe mounting of a screening device to the frame structure may occasionally only be obtained by use of additional fastening screws.

In DE patent no. 30 48 333 supporting means for a roller blind is disclosed comprising two support plates, one of which is provided with a slot for receiving a square pin in one end of the spring roller tube of the roller blind in a rotationally locked manner and the other one is provided with a circular hole. For alternative mounting of a Venetian blind, each support plate is provided with protrusions for engaging grooves in coupling members connected with the top casing of the Venetian blind, said members being pushed over the support plates. Subsequently, the side guide lists of the blind are mounted, said lists serving simultaneously as support for the coupling members and the top casing of the blind, i.e. as a safety against disconnection of the coupling member from the support plate.

Although this support arrangement allows for use of the same supporting brackets for different screening devices, a disadvantage of this design has been that for use with a roller blind supporting brackets of different design for receiving the spring roller tube of the roller blind, i.e. the slot and the circular hole, respectively, are required.

In U.S. Pat. No. 3,614,045 a supporting arrangement is disclosed comprising elongate slotted rails secured to the side members of the frame structure and extending throughout the height thereof and coupling members provided with hook-shaped engaging members to engage in slots of said rails and projecting at right angles in front of the frame structure. The less attractive appearance of this arrangement limits its application to draperies, which will hide the supporting arrangement, and does not quality to meet current demands for an aesthetical and functional design of windows and accessories like screening devices.

EP-A1-0,465,433 discloses an arrangement comprising a pair of identical tubus-shaped supporting brackets secured to opposed surfaces of frame side members, in each of which a transverse recess is formed receive a resilient clamping member of a form restoring the outer cylindrical form of the supporting brackets. This design is intended only for roller blinds having engaging means in the form of projecting cylindrical pins at either end.

WO 96/07007 discloses a roller shade mounted between a pair of supporting brackets projecting at right angles from the front side of the frame structure and formed with an undercut groove to receive a coupling member in the form of a slide engaged by the roller shade.

In SE-B-415,904 a roller blind support is disclosed comprising a pair of L-shaped bracket members in which edge flange portions on either side of a rectangular slit are engaged by resilient legs of an insert slide which can be pushed into the recess and is engageable by engaging means on the roller blind.

BRIEF DESCRIPTION OF THE INVENTION

On this background it is the object of the invention to provide supporting means for mounting a screening device in a rectangular frame structure lining a building opening, preferably on the frame or sash structure of a window, which has an attractive design meeting modern days user demands in respect of design quality and is easy and cheap to manufacture and the installation of which is simplified by a self-aligning design that may to a large extent compensate for production tolerances.

An additional object is to provide a standard design of the first pair of supporting brackets which can be premounted on the frame structure at the production site whereby simple installation of a variety of screening devices using various form of coupling members is made possible.

According to the invention these objects are met by supporting means as identified above, characterized in that the bracket members of said first pair are identical standard members for mounting on said opposed frame surfaces, each comprising a relatively flat front part protruding from said frame surface in the mounted position of said bracket member and having a substantially smooth external surface, and that said engaging means is provided by each coupling member and comprises first engaging means in the form of at least one contact surface on the coupling member engaging a circumferential surface part of a bracket member to provide temporary engagement therewith and non-resilient second engaging means providing stable engagement of the coupling member with respect to the frame structure.

By forming the bracket members as identical standard members the production thereof will become simple and cheap. The bracket members may tropically be mounted on opposed surfaces of the sash or frame side members facing the light area of a window and immediately below the top member of the sash or frame. Alternatively, the bracket members may also be mounted, however, on opposed surfaces of the sash or frame top and bottom members for accommodation of a screening device which is movable in the horizontal direction. Moreover the bracket members may be mounted with the circumferential surface part providing for temporary engagement with the contact surface of the coupling member extending either in the longitudinal direction of the frame or sash members on which they are mounted or transversely thereto. By the latter orientation the subsequent mounting of the coupling members on the bracket members becomes particularly simple, since the coupling members may be pushed onto the bracket members from the internal side of the window in a direction at right angles to the plane of the window pane.

Moreover, the provision of the engagement means in the form of first and second engagement means for temporary and stable engagement of the coupling member with respect to the bracket member and the frame or sash structure, respectively, facilitates the installation of a screening device. As will be further apparent from the following description the first engaging means can be designed for very easy temporary arrangement of the screening device with coupling members followed by provision or a stable and reliable fastening of the coupling members with respect to frame or sash structure, while the coupling members are held in temporary engagement with respect to the bracket members.

In general, the bracket members serve a two-fold purpose, namely on one hand to provide for accurate positioning of the coupling members and thereby the screening arrangement with respect to the frame structure and, on the other hand, to accommodate the load of the screening arrangement after establishment of the stable engagement of the coupling member with respect to the frame structure and transfer this load to the frame structure.

Preferred, but non-limiting embodiments of the supporting means according to the invention are stated in the dependent claims.

BRIEF DESCRIPTION OF THE DRAWINGS

The invention will be described in the following with reference to the schematic drawings, in which.

DETAILED DESCRIPTION OF THE INVENTION

Figure 1:
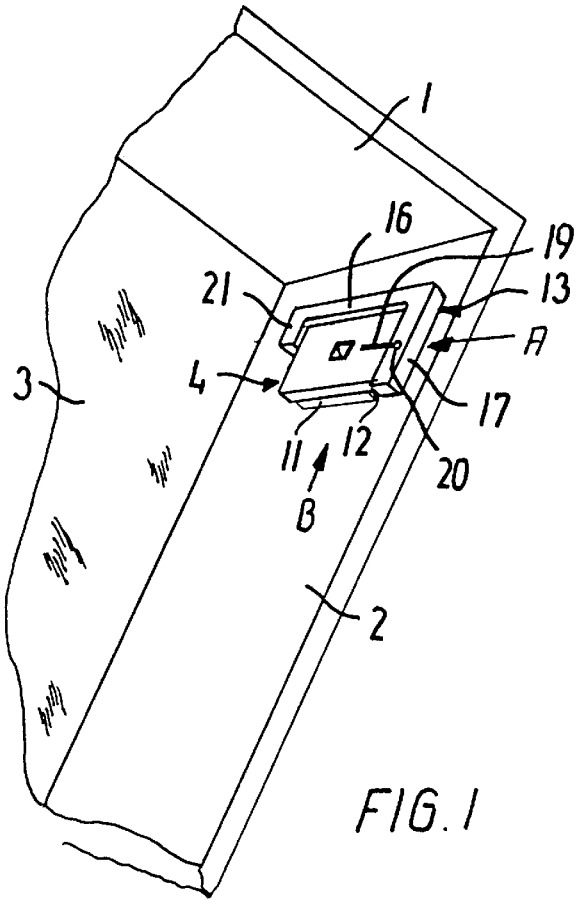
FIG. 1 shows an embodiment of the supporting means arranged on a side member of the frame or sash structure of a roof window.

FIG. 1 shows the upper right hand corner of a roof window with a frame structure including a horizontal top member 1 and a side member 2 extending in a vertical plane. Conventionally, the frame structure, which may constitute either the main frame of a stationary window or the sash of an openable window, will comprise a bottom member opposed to and parallel with the top member 1 and a left-hand side member opposed to the illustrated right-hand side member 2, so that the top, bottom and side members together form a generally rectangular structure framing the window pane 3.

For installation of a screening arrangement such as a roller blind, a pleated blind, a Venetian blind or the like on the internal side of the window pane 3 a bracket member 4 is secured to the side member 2 of the frame structure close to horizontal top member 1 as well as to the opposed left-hand side member, not illustrated in FIG. 1. The bracket members 4 are formed as a pair of identical standard members which can be used for installation of various types of screening arrangements.

Figure 2:
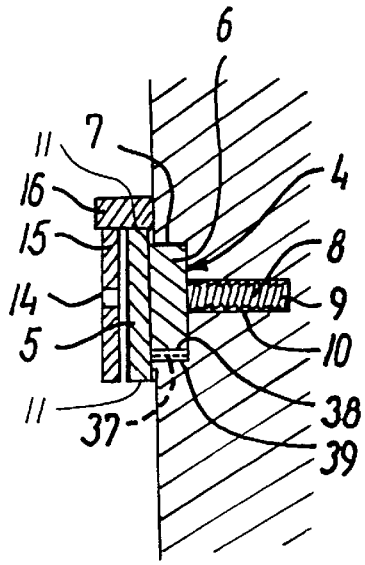
FIG. 2 is a sectional view of the arrangement of the supporting means illustrated in FIG. 1, FIGS. 3 and 4 show two alternative designs of a coupling member of the supporting means.

As shown in the sectional view in FIG. 2 each bracket member 4 comprises a relatively flat front part having a substantially smooth external surface and protruding from the surface of the frame side member 2 and a base section 6 secured in a hole or recess 7 in the frame side member 2 by means of pins 8 provided with external threading 9 or other suitable profiling to secure firm retainment of the pins in corresponding predrilled bores 10 in the frame side member 2, once the bracket member 4 has been pushed or driven into the side member 2. Typically, the front part 5, the base section 6 and the projecting profiled pins 8 of the bracket member 4 are formed in a single integrated piece, e.g. as a cast or moulded member of a suitable metal or plastic or a composite material.

In the embodiment in FIGS. 1 and 2 the front part 5 of the bracket member is formed as a generally rectangular flat plate member with two pairs of mutually parallel sides 11 and 12, respectively, but as will appear from the following description various alternative shapes of the front part of the bracket member are equally possible.

Figure 3:
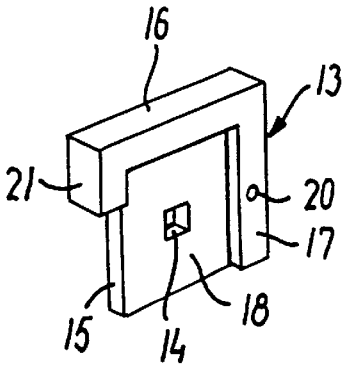

The projecting front part 5 of each bracket member 4, which will typically be pre-mounted on the window frame in connection with the production of windows, serves to receive and support a coupling member 13 supplied as one of a pair of coupling members together with the screening arrangement. As shown in FIGS. 3 to 10 the coupling member is provided with means engageable by engaging means on the screening device typically provided at either end of the screening device. For a screening device in the form of a roller blind the coupling member may e.g. be provided with a square hole 14 as shown in FIG. 3 to receive an end shaft of the winding rod or tube of the blind in a rotationally locked manner.

In accordance with the present invention the bracket and coupling members are provided with engaging means which comprises first engaging means in the form of at least one contact surface on the coupling member engaging a circumferential surface part of the bracket member to provide temporary engagement therewith and non-resilient second engaging means providing stable engagement of the coupling member with respect to the window frame structure.

In the embodiment shown in FIGS. 1 to 3 the square hole 14 constituting the means engageable by the screening arrangement is provided in a rigid plate section 15 of the coupling member 13 which is connected with an L-shaped arrangement of two legs 16 and 17, which as shown by the arrow A in FIG. 1 can be pushed onto the bracket member 4 from the internal side of the frame structure in a direction at right angles to the side member 2 with the legs 16 and 17 engaging adjoining side edges 11 and 12 of the projecting front part 5 of the bracket member 4. Thereby, the surfaces of legs 16 and 17 facing the open recess 18 defined by legs 16 and 17 and plate section 15 form contact surfaces of the coupling member 13 engaging circumferential surface parts of the bracket member 4 formed by side edges 11 and 12 to provide temporary engagement of the coupling member 13 with the bracket member 4.

Subsequently, stable engagement of the coupling member 13 with respect to the frame structure is established by second engaging means which as shown may comprise a nail or screw 19 introduced through a hole 20 in one of legs 16 and 17 into the underlying side member 2.

As shown in FIGS. 1 and 3 the temporary positioning of the coupling member 13 may be further facilitated by forming the free end of one of the legs such as the leg 16 with snap engagement means such as a short hook 21 engaging the other of the shore sides 12 of the bracket member 4.

Figure 4:
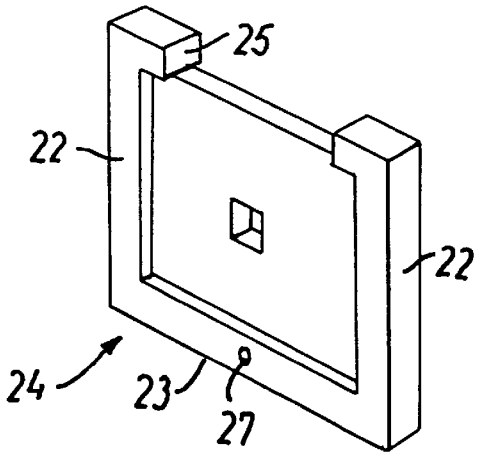

In the embodiment shown in FIG. 4 the L-shaped arrangement of legs 16 and 17 connected with the plate section 15 in FIG. 3 has been replaced by a U-shaped configuration of legs 22 projecting from a bottom piece 23 of the coupling member 24. As in the embodiment in FIG. 3 the free end of each of projecting legs 22 is formed with hook-shaped snap engagement means 25.

The coupling member 24 in FIG. 4 may be easily brought into temporary engagement with the rectangular front part 5 of the bracket member 4 in FIG. 1 by sliding the U-shaped configuration of legs 22 upwards in the longitudinal direction of the frame side member 2 as illustrated by the arrow B. Thereby, the projecting legs 22 will provide sufficient elastic deformability to allow the snap engagement means 25 at the free end of each of legs 22 to get into snap engagement with the upper long side 11 of the front part 5 of the bracket member, when the coupling member 24 is pushed upwards to bring the bottom piece 23 into contact with the lower long side 11. Subsequently, stable engagement of the coupling member with respect to the frame structure may be established in the same way as described above by means of a nail or screw introduced into the frame side member 2 through a hole 27 in the bottom piece 23.

Figure 5:
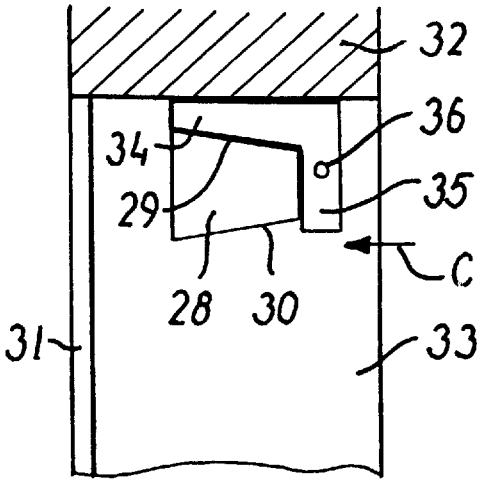
FIGS. 5 and 7 show further alternative embodiments of the supporting means.

As shown in FIGS. 5 to 10 various other designs of the bracket and coupling members is possible. In FIG. 5 the front part 28 of the bracket member is formed generally as a trapeze with upper and lower sides 29 and 30 converging towards each other in the direction from the window pane 31 towards the internal side of the frame structure with the horizontal top member 32 and the side member 33. As in the embodiment in FIG. 3 the coupling member comprises an L-shaped configuration of legs 34 and 35, of which the leg 34 is formed, however, with a wedge-like shape, whereby temporary engagement of the coupling member with the bracket member can be provided by sliding the coupling member onto the bracket member from the internal side of the window frame in the direction of arrow C, until the wedge-like leg 34 is squeezed between the inclining upper side 29 of the front part 28 and the underside of the horizontal frame top member 32. Stable engagement of the coupling member with respect to the frame structure may then be provided in the same way as described in the foregoing by introducing a nail or screw into the frame side member 33 through a hole 36 formed e.g. in leg 35 of the coupling member.

A temporary engagement of the coupling member with the bracket member by squeezing a leg of the coupling member may also be obtained e.g. with bracket and coupling members formed as shown in FIGS. 1 and 3 by mounting the bracket member 4 on the frame side member 2 with a spring bias in the direction towards the horizontal frame top member 1 corresponding to the direction of arrow B, whereby the hook-shaped snap engagement means 25 in FIG. 3 may be dispensed with. The spring bias of the bracket member may be obtained as shown in dashed lines in FIG. 2 by means of a spring such as a leaf spring 37 interposed between the underside 38 of the base section 6 of the bracket member 4 and the opposed edge part 39 of the hole or recess 7 in the frame side member 2.

Alternatively, a spring bias can be provided by means of a spring acting between the upper side of the bracket member and the contact surface of the coupling member in engagement therewith, e.g. by means of a leaf spring mounted in the underside of the corresponding leg 34 of the coupling member, or as described in further detail below in connection with the embodiment of FIGS. 8 to 10.

Figure 6:
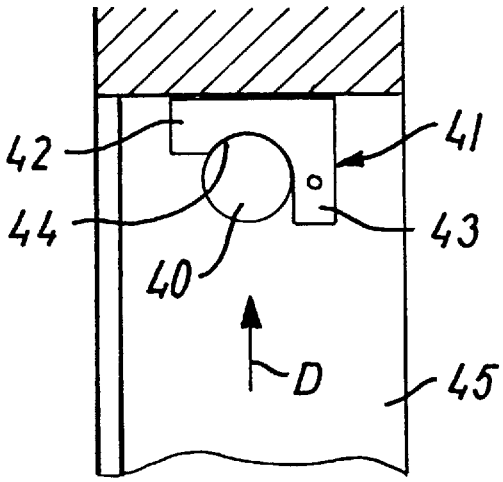

In FIG. 6 an embodiment is shown, in which the front part 40 of the bracket member is generally circular and the coupling member 41 comprises a generally L-shaped configuration of legs 42 and 43, in which the underside of leg 42 forming a contact surface for engagement with the upper circumferential edge part 44 of the bracket member is formed with a curvature matching the circular curvature of the front part 40. In the same way as described above the temporary engagement between the coupling and bracket members may be assisted by mounting the bracket member in the frame side member 45 with a spring bias in the direction or arrow D.

Figure 7:
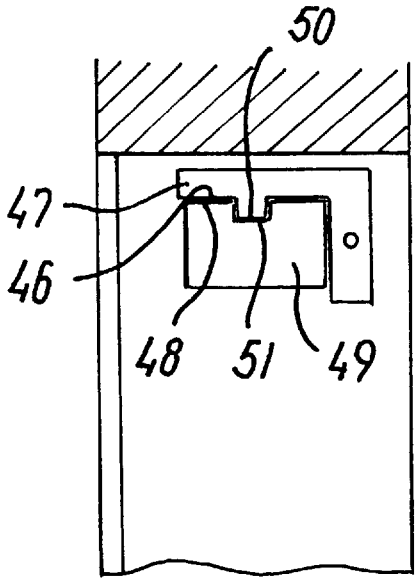

As shown in FIG. 7 the temporary engagement of the coupling member with respect to the bracket member may alternatively be obtained by forming the contact surface 46 provided by one leg 47 of an L-shaped configuration and the circumferential surface part 48 of the front part 49 of the bracket member with interfitting profile shapes such as a projecting notch 50 from the contact surface 46 and a recess 51 for receiving said notch in the surface part 48.

Whereas in FIGS. 4 to 7 only the part of coupling members serving to provide temporary and stable engagement with respect to the bracket members and the frame structure, respectively, are shown, it is understood that in each embodiment the coupling member will also comprise means, such as the square hole 14 in the plate section 15 shown in FIG. 3, engageable by mating means of the screening device.

Figure 8:
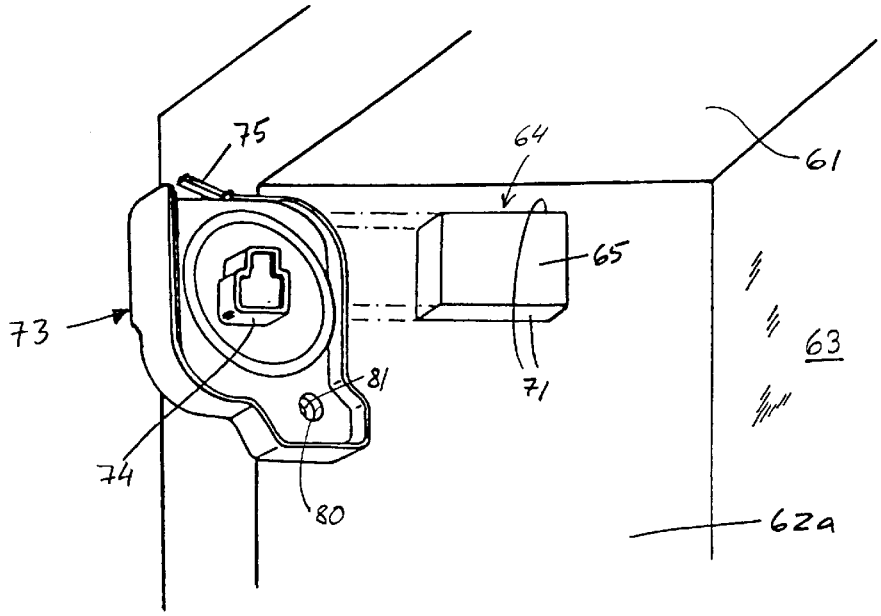
FIG. 8 shows a perspective view of an alternative embodiment of the supporting means arranged in the upper left-hand corner of a roof window, FIG. 9 show a perspective view of a screening device.
Figure 9:
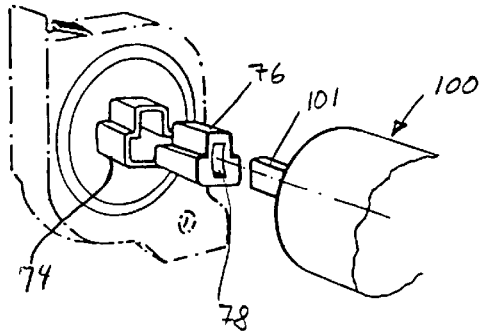
Figure 10:
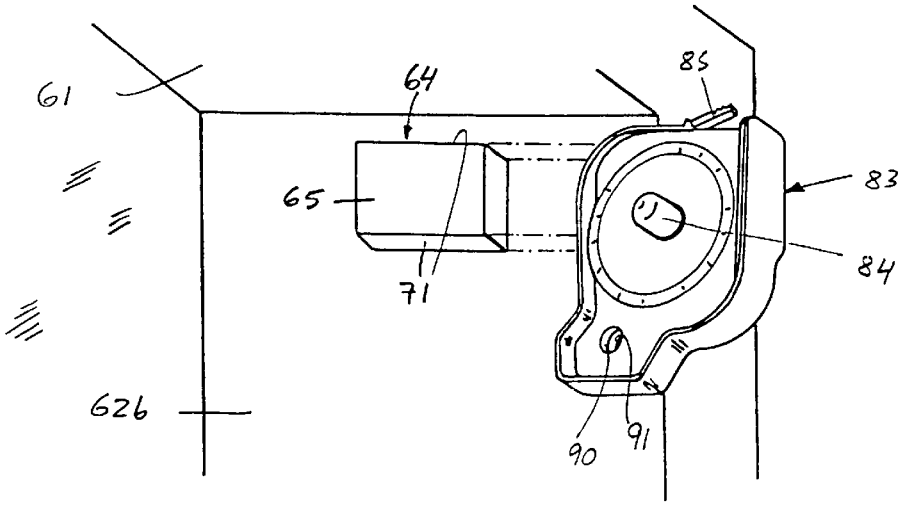
FIG. 10 is a view corresponding to FIG. 8 but of the upper right-hand corner of the window.

An alternative embodiment is shown in FIGS. 8 to 10, in which the coupling members 73,83 to be arranged on bracket members 64 each comprises a mainly disc-shaped configuration. The bracket members 64 may be of substantially the same design as described in connection with the above embodiments, eg. as the one of FIGS. 1 to 3, and is mounted on the side members 62*a*,62*b* of the frame structure close to the adjoining horizontal frame member 61. Each coupling member 73,83 has on its back side, not shown, contact surfaces for engaging at least the upper of the long sides 71 of the front part 65 of the bracket member 64 for providing the temporary engagement therewith. In order to increase the effect of the temporary engagement, each coupling member 73,83 has at its upper side means for squeezing the coupling member 73,83 between the upper long side 71 of the front part 65 of the bracket member 64 and the adjoining horizontal frame member 61. In the embodiment shown, these means comprise a flap 75,85 protruding at an angle from the upper side of the coupling members 73 and 83, respectively, and providing a spring bias between the upper frame member 61 and the bracket member 64 of course, two or more flaps may be provided, either side by side, successively or in other geometrical arrangements.

Alternatively, the squeezing means may comprise a wedge-like protrusion on the upper side of each coupling member.

As in the embodiments described in the above, stable engagement of the coupling member 73,83 with respect to the frame structure is subsequently established by second engaging means which may comprise a nail or screw introduced through a hole 80, 90 and into the underlying side member 62*a*,62*b*.

In order to further facilitate the arrangement of the screening device on the supporting means, each of the holes 80, 90 is provided with a circumferential fin 81, 91 for temporary retention of the fastening member.

In FIG. 9 is shown a screening device in the shape of a roller blind 100 having a one end a square or rectangular pin 101. The means on the coupling member 73 which are engageable by said pin 101 comprise an adapter piece 76 having a cross-section which is asymmetric with respect to at least one axis and fitting into a socket 74 on the coupling member 73. As indicated, the adapter piece 76 may be provided together with the screening device and may comprise an arc-shaped slit 78. The engaging means on the opposite coupling member 83 may as shown comprise a pin 84 which fits into a corresponding hole, not shown, in the end of the roller blind which is opposite the end having the square or rectangular pin 101.

What is claimed is:

1. A support for a screening device in a frame structure with frame members comprising top and bottom members (1; 32; 61) as well as side members (2; 33; 45; 62*a*, 62*b*) and lining an opening in a building, the support comprising a first pair of bracket members (4; 64) for mounting on each of a pair of opposed parallel frame surfaces (2; 33; 45; 62*a*, 62*b*) of said frame structure and a second pair of coupling members (13; 24; 41; 73, 83) each provided with means (14; 74, 84) engageable by said screening device, said bracket members and said coupling members (4, 13; 24; 41; 64, 73, 83) further comprising engaging means for engagement of one of said coupling members with one of said bracket members, wherein the bracket members (4; 64) of said first pair are identical standard members for mounting on said opposed frame surfaces (2; 33; 45; 62*a*, 62*b*), each comprising a relatively flat front part (5; 28; 40; 49; 65) protruding from said frame surface (2; 33; 45; 62*a*, 62*b*) in the mounted position of said bracket member and having a substantially smooth external surface, and said engaging means comprises first engaging means in the form of at least one contact surface (16, 17, 21; 22, 23, 25; 34, 35; 42, 43; 46) on the coupling member (13; 24; 41; 73, 83) engaging a circumferential surface part (11, 12; 29; 44; 48; 71) of a bracket member to provide temporary engagement therewith and non-resilient second engaging means (19, 20; 27; 80, 90) providing stable engagement of the coupling member (13; 24; 41; 73,83) with respect to the frame structure.

2. The support as claimed in claim 1, wherein the front part (5, 28) of each bracket member (4) is substantially polygonal, and each of said contact surfaces (16, 17, 21; 22, 23; 34, 35) of the coupling member and said circumferential surface part (11, 12) of the bracket member (4) comprises at least two engagement sections forming an angle with each other to provide said temporary engagement.

3. The support as claimed in claim 2, wherein the front part (5) of said bracket member (4) is substantially rectangular, said first engagement means is in the form of a plurality of contact surfaces, and said coupling member (13, 24) forms an open recess (18) conforming to said front part (5) and limited by said contact surfaces engaging adjoining sides of the bracket member.

4. The support as claimed in claim 3, wherein the coupling member (13) comprises a generally L-shaped configuration of two legs (16, 17) substantially at right angles to each other, said legs forming said contact surfaces.

5. The support as claimed in claim 3, wherein said coupling member (24) comprises a substantially U-shaped configuration of legs (22, 23) engaging opposed sides (12) of the front part (5) of the bracket member (4).

6. The support as claimed in claim 4, wherein a free end of at least one leg (16, 22) of the coupling member is formed with snap engaging means (21, 25) engaging a side (12, 11) of the front part (5) of the bracket member (4) adjoining the side (11, 12) engaged by said at least one leg (16, 22).

7. The support as claimed in claim 4, wherein said bracket member (4) is adapted for mounting on at least one of said side members (2, 33) of said frame structure extending in a substantially vertical plane close to an adjoining horizontal frame member (1, 32), and at least one of the legs (16, 34) of the coupling member (13) provides said temporary engagement by being squeezed between the front part (5, 28) of the bracket member (4) and said adjoining horizontal frame member (1, 32).

8. The support as claimed in claim 7, wherein said leg (34) of the-coupling member is generally wedge-shaped and engages a side (29) of the front part (28) of the bracket member facing said horizontal frame member (32).

9. The support as claimed in claim 7, wherein a spring bias against said horizontal frame member (1) is provided to act on the bracket member (4) and/or the coupling member (13).

10. The support as claimed in claim 9, wherein each of the brackets has a base section, each of the frame members defines a hole or recess, and said spring bias is provided by means of a leaf spring (37) interposed between the underside (38) of the base section (6) of the bracket member (4) and the opposed edge part (39) of the hole or recess (7) in the frame side member (2).

11. The support as claimed in claim 1, wherein said bracket member (64) is adapted for mounting on at least one of said side members (62*a*, 62*b*) of said frame structure extending in a substantially vertical plane close to an adjoining horizontal frame member (61), and each coupling member (73,83) on its upper side comprises means for squeezing said coupling member between the front part (65) of the bracket member (64) and said adjoining horizontal frame member (61).

12. The support as claimed in claim 11, wherein said squeezing means comprises a wedge-shaped protrusion.

13. The support as claimed in claim 11, wherein said squeezing means comprises at least one flap (75,85) protruding at an angle from said upper side of each coupling member (73,83).

14. The support as claimed in claim 1, wherein said contact surface (42) of the coupling member (41) and said circumferential surface part (44) of the front part (40) of the bracket member are curved with curvatures conforming to each other.

15. The support as claimed in claim 1, wherein said contact surface (46) of the coupling member and said circumferential surface part (48) of the front part (49) of the bracket member are formed with interfitting profile shapes (50, 51).

16. The support as claimed in claim 1, wherein said second engaging means comprises a hole or a bore (20; 27; 36; 80, 90) in the coupling member (13; 24; 73, 83) to receive a fastening member (19) for securing the coupling member with respect to said frame structure.

17. The support as claimed in claim 16, wherein each of said holes (80, 90) is provided with a circumferential fin (81, 91) for temporary retention of said fastening member.

18. The support as claimed in claim 1, wherein said screening device is a roller blind having at one end a square or rectangular pin, and the means (74) engageable by said screening device is engageable by said pin and comprises an adapter piece (76 having a cross-section which is asymmetric with respect to at least one axis and fitting into a socket (77) on said coupling member (73).

19. The support of claim 1, wherein the bracket members are adapted for mounting on the frame structure of at least one of a door and a window.

* * * * *